United States Patent [19]

Chiu et al.

[11] Patent Number: 4,967,805

[45] Date of Patent: Nov. 6, 1990

[54] MULTI-PLY FORMING FABRIC PROVIDING VARYING WIDTHS OF MACHINE DIRECTION DRAINAGE CHANNELS

[75] Inventors: Kai F. Chiu; Antonius F. Rietvelt, both of Brandon, Miss.; James S. Rugowski, Appleton; Greg A. Wendt, Neenah, both of Wis.

[73] Assignee: B.I. Industries, Inc., Florence, Miss.

[21] Appl. No.: 355,996

[22] Filed: May 23, 1989

[51] Int. Cl.[5] ..... D03D 11/00

[52] U.S. Cl. ..... 139/383 A

[58] Field of Search ..... 139/383 A, 425 A; 413/415; 162/348, DIG. 1; 428/224, 234, 257

[56] References Cited

U.S. PATENT DOCUMENTS

| | | | |
|---|---|---|---|
| 3,230,136 | 1/1966 | Krake | 162/111 |
| 4,116,756 | 9/1978 | Quee | 139/413 X |
| 4,231,401 | 11/1980 | Matuska | 139/425 A |
| 4,499,927 | 2/1985 | Borel | 139/413 |
| 4,554,953 | 11/1985 | Borel et al. | 139/383 A |
| 4,705,601 | 11/1987 | Chiu | 162/348 |
| 4,789,009 | 12/1988 | Troughton | 139/383 A |
| 4,821,780 | 4/1989 | Tate | 139/425 A |
| 4,832,090 | 5/1989 | Kreukel et al. | 139/383 A |

*Primary Examiner*—Andrew M. Falik

*Attorney, Agent, or Firm*—Dann, Dorfman, Herrell and Skillman

[57] ABSTRACT

A forming fabric for use in papermaking machines for making tissue products in which the fabric is a three-ply fabric. The upper ply has its machine direction (MD) filaments arranged in groups so that wide channels are provided through the ply between the groups and narrow channels are provided through the ply within the groups. Cross direction (CD) filaments in the upper ply provide CD knuckles spanning across the channels to provide a gridwork for supporting fibers separated from the water of the slurry deposited on the forming fabric, the fibers having a greater density in bands overlying the wide channels than in the intermediate bands overlying the narrow channels. The lower ply is a porous fabric which further controls the flow of the water discharged from the pulp through the upper ply. The two plies are interconnected by integrated binder filaments which cooperate to maintain the groupings of the MD filaments in the upper ply. The predominant CD knuckles on the paper side of the fabric provide topographic lines crossing the MD channels diagonally in both directions.

13 Claims, 4 Drawing Sheets

FIG. 6

```
-XX------XX------XX------XX------XX-----
X----------X--------X----------X--------
----X----------X--------X----------X----
-----XX------XX------XX------XX------XX-
--------X----------X--------X----------X
---X--------X----------X--------X-------
-XX------XX------XX------XX------XX-----
-------X--------X----------X--------X---
----XXXX----XXXX----XXXX----XXXX----XXXX
```

FIG. 5

```
X X X X X - - - - - - - X X X X
X X X X X X X X X X X X X - - X
- - - X - - - - - - - X - - - -
X - - - - - - - X - - - - - - -
X X X X X X X X X - - X X X X X
- - - - - - - X - - - - - - - X
- - - - X - - - - - - - X - - -
- - - X X X X X X X X X - - - -
X X X X X - - X X X X X X X X X
X - - - - - - - X - - - - - - -
- - - - - - - X - - - - - - - X
X - - X X X X X X X X X X X X X
- - - - X - - - - - - - X - - -
- - - X - - - - - - - X - - - -
X - - - - - - - X X X X X X X X
X X X X X X X X X X X X X - - X
- - - - - - - X - - - - - - - X
- - - - - X - - - - - - - X - -
X X X X X X X X X - - X X X X X
- - - - X - - - - - - X - - - -
X - - - - - - - X - - - - - - -
X X X X X X X X - - - - - - - X
X X X X X - - X X X X X X X X X
- - - - X - - - - - - - X - - -
- - - X - - - - - - - X - - - -
X - - X X X X X X X X X X X X X
X - - - - - - - X - - - - - - -
- - - - - - - X - - - - - - - X
```

MULTI-PLY FORMING FABRIC PROVIDING VARYING WIDTHS OF MACHINE DIRECTION DRAINAGE CHANNELS

FIELD OF THE INVENTION

The present invention relates to fabrics employed in papermaking machinery including forming fabrics, backing fabrics, transfer fabrics, drying fabrics and imprinting fabrics for use on single wire or multiple wire paper machines. The invention is specifically directed to multi-ply fabrics made of synthetic filaments for use in papermaking machines to remove water and to support the paper stock at the wet end of the papermaking process, particularly for making tissue products.

BACKGROUND OF THE INVENTION

In the manufacture of tissue products, such as facial tissues, the developments over the years have led to ever-increasing production speeds, and at the current time the production speeds of the papermaking machinery is upwards of 5000 feet per minute, generally in the range of 3000 to 6500 feet per minute. The aqueous slurry of pulp is deposited on the forming fabric (fourdrinier wire) at the head box, and the water from the slurry is drained through the wire at the wet end of the papermaking machine. From the fourdrinier wire, the dewatered pulp is transferred to a felt which expresses further water from the pulp before it is transferred to the Yankee dryer. As the paper is stripped from the Yankee dryer, it is creped by the doctor blade and is wound onto rolls for subsequent converting into facial tissue, toweling, or the like.

Softness has been a desirable characteristic of the tissue products, and there has been a continuing effort to provide enhanced softness without sacrificing strength. Efforts to improve softness have included embossing during the subsequent conversion of the webs into tissue, toweling or the like. The embossing provides a tactile characteristic to the product which combines with a visual cloth-like look to enhance the impression of softness upon the consuming public.

Previous efforts to provide a pattern effect have been directed to the dry end of the process inasmuch as it was believed that the high-speed production techniques used in tissue-making required the maximum uniformity in the sheet formed on the forming wire with a minimum of density variation or basis weight variation throughout the area of the sheet. Pinholing in the sheet resulting from non-uniform disposition of pulp on the wire was believed to be particularly disadvantageous since the appearance of pinholes normally was accompanied by a difficulty in stripping the tissue off the forming fabric and creping the paper as it comes from the Yankee dryer.

The conventional teaching is to form a lightweight sheet of tissue by using a forming fabric with a fine mesh so as to assure uniform basis weight throughout the sheet, which also produces a smooth, non-texturized sheet which is readily released from the forming fabric onto the press or dryer felt.

SUMMARY OF THE PRESENT INVENTION

The present invention is based on the discovery that it is possible to produce satisfactory tissue from a sheet which is not uniform throughout, but which is possessed of a regular pattern of optically-densified areas containing higher mass concentrations of fibers. It has been found that by employing the forming fabric of the current invention, despite having varying concentrations of fibers within the sheet, the release of the paper sheet from the fourdrinier wire to the press or dryer felt is not impaired, and it is possible to produce a sheet having a pattern of densified areas which is detectable in the final product.

Experimental work in producing a sheet with some characteristics of the sheet of the present invention is described in U.S. Pat. No. 3,230,136 in which the fourdrinier wire, at that time made of bronze or other metallic filaments, provided controlled drainage of the pulp to produce a longitudinally-ribbed pattern in the web produced by the wire. So far as it can be determined, the web produced by the apparatus described in the patent was not susceptible to commercial production mainly due to severe pinholing and difficulties in sheet release from the wire resulting in sheet breaks even at machine speeds lower than 3000 feet per minute.

The present invention provides an improved fourdrinier wire which is suitable for commercial production of tissue having a fine, regular pattern of optically-densified areas containing higher mass concentrations of fibers. The web produced by the wire of the present invention is devoid of any substantial degree of pinholing which is not a desirable characteristic of tissue paper having a pleasing surface feature and appearance which can be described as "woven and cloth-like".

The present invention provides a forming fabric for a papermaking machine in which the fabric consists of a multi-ply structure having an upper ply of a self-sustaining weave construction, a lower ply also of self-sustaining fabric construction, and binder filaments interconnecting the two plies into a unitary structure having controlled porosity to afford drainage of the water from the pulp slurry deposited on the fabric at the wet end of the papermaking machine.

The improved forming fabric of the present invention is characterized by a weave construction in the upper ply which embodies machine direction (MD) filaments disposed in groups such that the spacing between the groups is sufficient to provide a wide drainage channel extending in the machine direction and the spacing between the filaments within the group providing narrow drainage channels also extending in the machine direction. Flow of water through the forming fabric is further controlled by the lower ply which provides a porous structure underlying the respective channels in a fashion to control the drainage of water through the forming fabric.

In the preferred embodiment of the invention, the binder filaments between the plies cooperate to maintain the MD filaments of the upper ply within the groupings and cooperate to position the MD filaments in the lower ply beneath the wide channels of the upper ply, creating open channels between selected filaments which are out of vertical registry with the wide channels to further control the drainage of water through the channels The forming fabric is preferably provided with at least one diagonal twill pattern on the upper surface which imparts to the sheet being formed on the fabric a detectable appearance of a series of diagonally-extending lines or more than one series of diagonally-crossing lines complementary to the machine direction lines provided by the optically-densified areas within the sheet, thereby enhancing the cloth-like appearance.

BRIEF DESCRIPTION OF THE DRAWINGS

All of the objects of the invention are more fully set forth hereinafter with reference to the accompanying drawings, wherein:

FIG. 5 is a weave chain diagram of an example of a multi-layer construction with an interrupted 1×3 twill weave on the top layer;

FIG. 6 is a weave chain diagram of an example of a multi-layer construction with an interrupted 1×4 atlas weave on the top layer;

DESCRIPTION OF A PREFERRED EMBODIMENT

Figure 1:
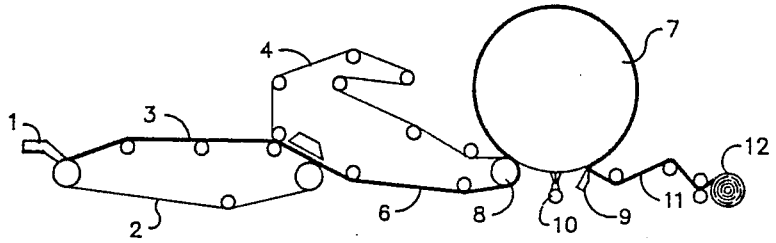
FIG. 1 is a diagrammatic view of a typical papermaking machine for tissue production.

Referring now to the drawings, and in particular to FIG. 1 thereof, there is illustrated a typical papermaking machine for the formation of a tissue product. In the embodiment shown in FIG. 1, the papermaking machinery includes a head box 1 which deposits an aqueous slurry of papermaking fibers onto a continuous forming fabric 2 disposed in a generally horizontal run on which a sheet or web of fibrous stock is formed. The water is extracted from the slurry and is channeled and drained through the forming fabric by suction devices underlying the run to form a regular pattern of densified areas comprising higher mass concentrations of fibers relative to the balance of the web. The newly-formed web 3 is transferred to a felt 4 using a vacuum pickup shoe and is further dewatered by expressing the water from the web and subjecting it to air drying. The web is then transferred to a Yankee dryer 7 with a pressure roll 8 and is doctored from the dryer using a doctor blade 9. Creping adhesive may be applied to the surface of the Yankee dryer in advance of the pressure roll 8 by a spray boom 10. After being creped and upon removal from the Yankee dryer, the web 11 is wound onto a hard roll 12 for subsequent converting into facial tissue toweling or the like.

As discussed above, the forming fabric 2 is constructed to provide a predetermined pattern of optically-densified areas containing higher mass concentrations of fiber in the sheet formed on the fabric. In the present instance, the areas of high density fibers in the sheet are arranged in longitudinal MD line patterns (or bands) separated by MD line patterns (bands) of less dense fibers.

The line patterns of varying density in the sheet traveling through the papermaking machinery tend to cause corresponding variations in the drYness of the sheet in bands across the width. Such bands of dryness extend longitudinally of the sheet and do not adversely affect the strength of the sheet and its ability to withstand the normal handling of the papermaking apparatus.

Figure 2:
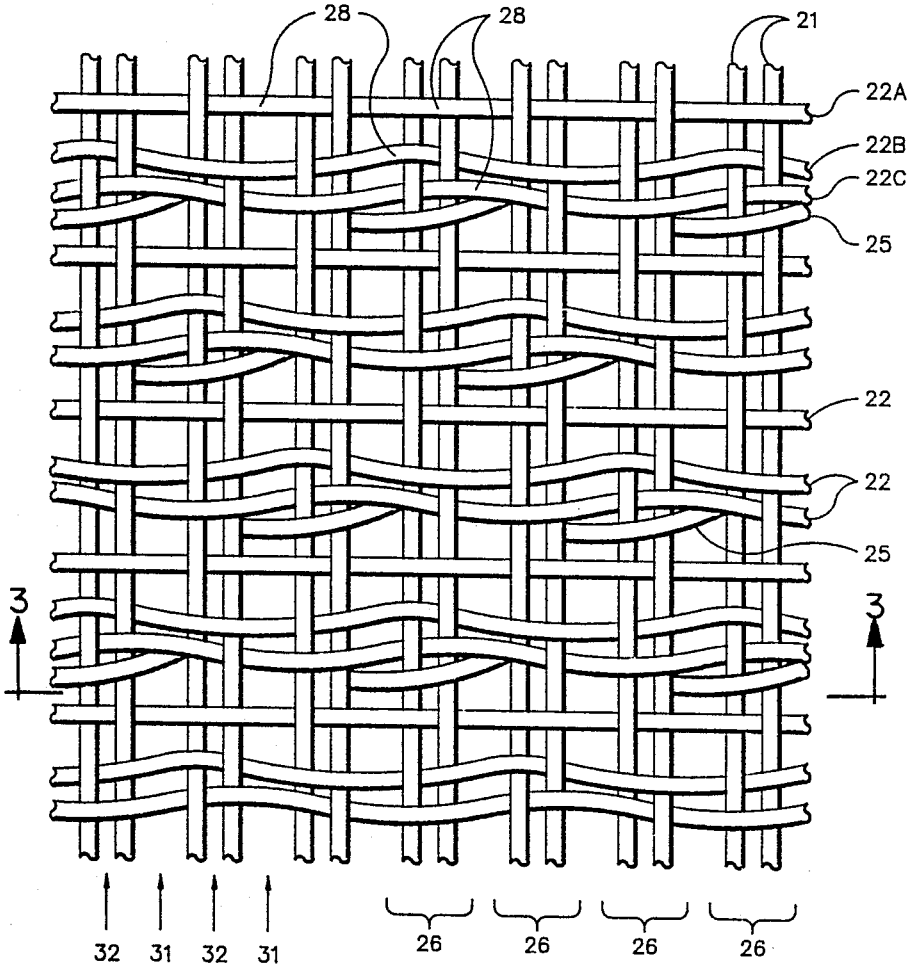
FIG. 2 is a plan view of the upper ply of a forming fabric made in accordance with the present invention.
Figure 3:
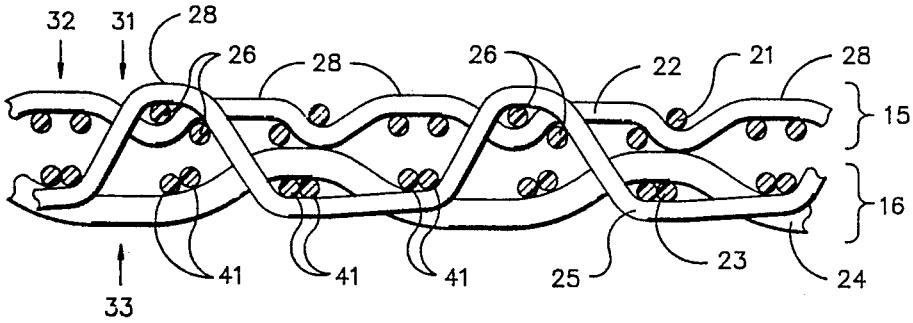
FIG. 3 is a sectional view taken on the line 3—3 of FIG. 2.
Figure 4:
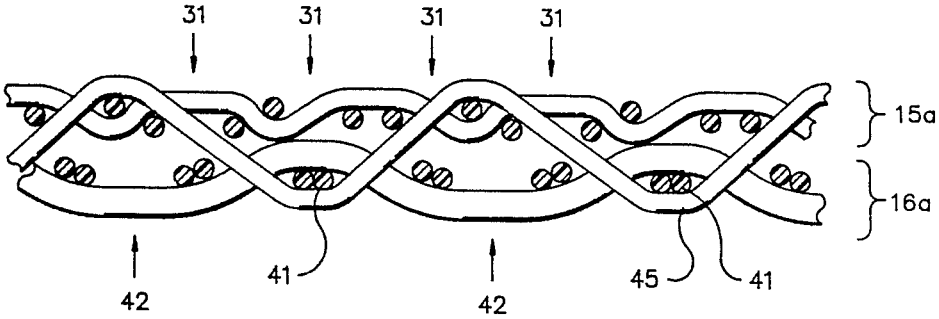
FIG. 4 is a sectional view similar to FIG. 3 showing a modified weave of the fabric.

In order to provide the bands of higher density fibers in the sheet material as it is discharged from the head box, the forming fabric as shown in FIGS. 2–4 is a so-called 3-ply fabric consisting of an uppermost ply 15 comprising a self-sustaining weave construction having monofilament warp yarns 21 of a given diameter interwoven with shute yarns 22 in a selected weave pattern. The lowermost ply 16 is also constructed of warp yarns 23 and shute yarns 24 in a self-sustaining weave construction. The interconnecting ply comprises binder yarns 25 which are interwoven respectively with the uppermost and lowermost plies to form a composite three-ply fabric.

In accordance with the invention, the upper ply 15 is designed to provide an array of elongated cross-direction (CD) knuckles 28 spanning multiple MD filaments 21 to form a CD-knuckle-dominated top surface in a interrupted 3 shed twill pattern (in FIG. 2, a 1×2 twill). As shown in FIGS. 2 and 3, MD filaments 21 comprise monofilaments disposed in relatively straight alignment in groups of two with a narrow channel 32 in between as indicated at 26. The first three top CD filaments 22A, 22B, 22C extend over two adjacent MD filaments 21 and under a third machine direction filament 21 in a twill pattern. The fourth top CD filament 25 (herein referred to as an integrated binder yarn) follows a twill pattern which is interrupted at alternating knuckle points. It goes over two top MD filaments 21 and one pair of bottom MD filaments, underneath two pairs of bottom MD filaments 41 (see FIG. 3) and four top MD filaments 21, and then repeats again over two top MD filaments 21. In taking such a weave path, this CD filament functions as (1) a partial top long knuckle for fiber support, (2) a binder yarn to tie in the top and bottom layers, (3) a grouper yarn to cause the two top MD filaments 21 to twin together and (4) a position yarn to control the location of the bottom MD filaments 41 as in relationship to the wide channel 31 formed by the top layer MD filaments 21 which will be described later. As shown, this weave of the filaments, when woven with normal tension on the filaments in the machine direction, produces a fabric in which the MD filaments 21 are disposed relatively straight and parallel. On the other hand, selected CD filaments may be straight as shown at 22A and others may have a zig-zag pattern as shown at 22B and 22C traversing the MD filaments 21. The zig zag pattern results from the CD filaments 22B and C being at varying distances from the relatively straight CD filaments 22A. As shown in FIG. 2, the machine direction filaments 21 are arranged in groups 26 of two so as to provide a relatively wide drainage channel as indicated at 31 between the groups 26 of MD filaments 21, whereas within the group 26, a narrow drainage channel 32 is provided between the filaments 21 within the group.

By reason of this arrangement in the upper ply 15, as the forming fabric travels under the head box at the rate of about 3000 to 6500 feet per minute, the slurry deposited by the head box permits the fiber content of the slurry to be deposited and supported across the CD knuckles, allowing the water of the slurry to be channeled between the MD filaments 21. In view of the larger width of the wide channels 31 relative to the narrow channels 32, the slurry is directed to flow through the wide channels, carrying with it a larger percentage of the fibers for depositing across the knuckles overlying the larger channels. To some degree, fibers will span over the knuckles overlying the narrow channels 32, but the density of the fibers overlying the wide channels will be greater than the density of the fibers overlying the narrow channels. The diagonal pattern of the knuckles provides a relatively uniform supporting grid for the fibers throughout the entire surface area of the forming fabric, but the channels underlying the knuckles afford concentration of the fibers on the surface in the MD line patterns or bands overlying the wide channels.

In the upper ply 15, the wide channels 31 as seen from the top view shown in FIG. 2 are on the order of three times the width of the narrow channels 32. It is believed that the grouping of the MD filaments is effective to provide bands of greater density fiber when the channels 31 are at least 50% larger in width than the channels 32. It is believed that when the wider channels become more than six times the width of the narrow channels, the concentration of fibers in the wider channels will be of such greater density than in the narrow channels as to impair the integrity of the paper. Thus, the operative range of ratios of the wider channel width to the narrow channel width is believed to fall within the range of 1.5 to 6.

The lowermost ply of the forming fabric cooperates to control the flow of the water from the slurry through the respective wide and narrow channels of the uppermost ply. To this end, the lowermost ply in the present embodiment comprises a $1\times2$ twill pattern which the MD filaments 23 of the lowermost ply operate in paired groups 41 rather than singly. In this way, each pair provides a filament having an effective width which is greater than its height. The illustrated arrangement of longitudinally abutting paired MD filaments in the lowermost ply may be modified by using a single ovate (or so-called flat) as described in U.S. Pat. No. 4,705,601, or in groups of more than two small round filaments in the lowermost ply. The use of flat warps or longitudinally abutting groups of MD filaments enhances the wear resistance of the fabric without sacrificing fabric thinness.

The weave pattern of the integrated binder yarn 25, which is interwoven with the upper and lower plies, affects the porosity of the composite forming fabric. As shown in FIGS. 2 and 3, the integrated binder yarns 25 are shute yarns which extend in the cross direction and pass through the upper ply and over the warp yarns 21 in the group 26 so as to cooperate to reinforce the grouping of the filaments 21 in the upper ply. The binder yarn 25 then passes, as shown in FIG. 3, under two adjoining pairs 41 of machine direction filaments in the lower ply before passing upwardly over the group 26 in the upper ply spaced four MD filaments over from the first group 26 over which it passes. As shown in FIG. 3, the binder yarn thereby positions a lower MD open channel 33 between the paired machine direction filaments 41 in the lower ply in vertical registry with the channel 31 in the upper ply to enhance the localized drainage through the forming fabric.

FIG. 4 shows an alternate weave arrangement in which the upper ply **15*a* is identical to the ply 15 of FIG. 3, and the weave of the lower ply 16*a* is identical to the ply 16. In this embodiment of the three-ply fabric,, the integrated binder filaments 45 extend under a single pair 41 of MD filaments in the lower ply 16*a* to provide a lower MD open channel 42 which is out of vertical registry with the wide upper channel 31**, affording a somewhat different control of the drainage flow through the fabric.

In either case, the control of the drainage through the forming fabric is determined primarily by the channels provided between the groups 26 of machine direction yarns in the upper ply. The grouping of the machine direction yarns may be accomplished by suitable selection of weave patterns when weaving the fabric, such that the tensions applied to the warp and shute yarns during the weaving operation control the spacings between the yarns to produce the desired machine direction channels. Since the filaments are normally polyester or nylon, they are heat set to maintain the desired spacing when put onto the papermaking machine. In addition to controlling the spacing by the weave patterns and tensions, the spacing may be controlled by threading the loom for weaving the forming fabric with empty dents in the upper ply between the dents in which the grouped MD yarns 21 are carried. The skilled weave designer can combine various features to provide grouped MD filaments as desired in the forming fabric. Furthermore, the shedding of the fabric may use regular shedding or may use atlas shedding, if desired. Examples of such other weave patterns are shown in FIG. 5 and FIG. 6.

In the lowermost ply, the relatively large CD shutes predominate on the machine side of the forming fabric so as to provide wear potential as it travels through the papermaking machine and stability characteristics to minimize wrinkling, which permits prolonged use of the forming fabric between replacements.

The invention herein is particularly applicable to the making of tissue webs, but it may also be applicable to heavier paper grades, although the variations in optical density in sheets of heavier paper is not as apparent and the pattern appearance would not be as predominant.

Figure 7:
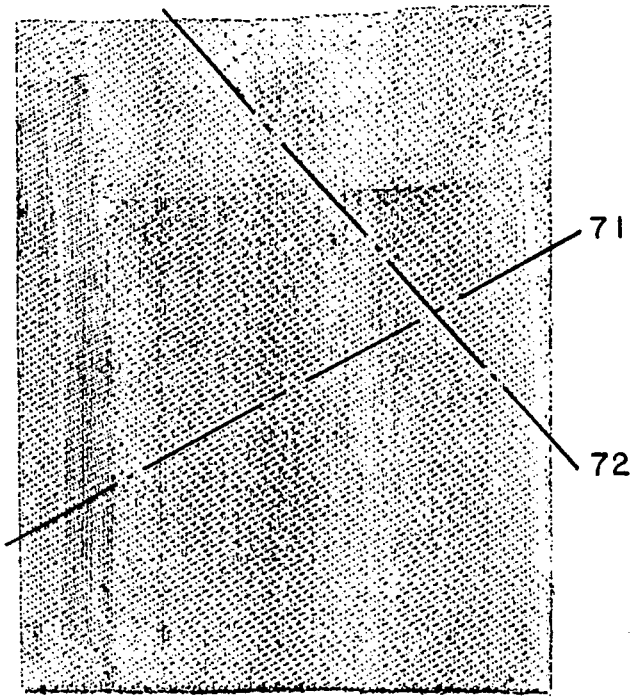
FIG. 7 is an actual pencil tracing made on the top layer of a forming fabric of the current invention with an interrupted 1×2 twill weave.

It is noted that the CD knuckles on the upper surface of the forming fabric predominate by reason of the fact that the MD knuckles are shorter in length and are more deeply embedded in the body of the upper ply. By having the CD knuckles project above the MD knuckles, a twill pattern of CD knuckles is evident from an inspection of the forming fabric. FIG. 7 is an actual pencil tracing of the top side of the fabric. On one hand, it shows the expected diagonal series of twill line pattern 71 typical of a 3 shed ($1\times2$) weave. On the other hand, it shows an unexpected opposing diagonal line pattern 72.

The pencil tracing of FIG. 7 establishes that the diagonal lines are topographic, whereas the MD channels are embodied with the fabric. The surface topography on the paper side of the fabric may provide a degree of embossing on the paper web produced on the forming fabric, and this effect is not completely lost during the subsequent stages in the papermaking process. The channels within the fabric, on the other hand, provide the MD pattern lines of varying density described above.

Figure 8:
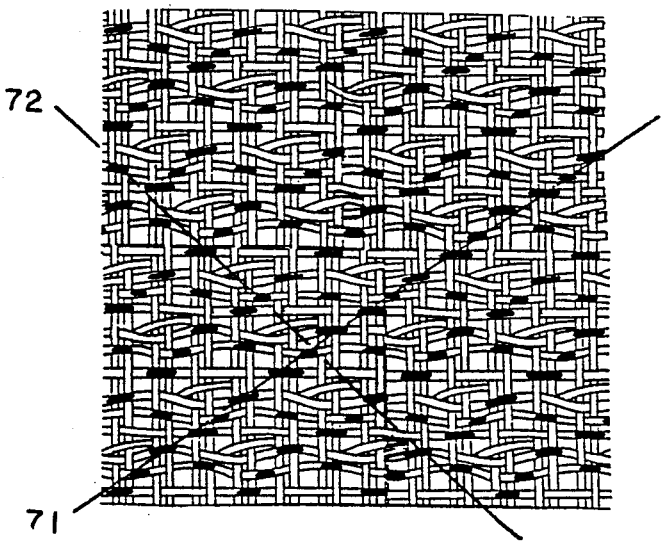
FIG. 8 is a view similar to FIG. 2 in which the high CD knuckles have been, shaded to demonstrate the effect of the pencil tracing cone in FIG. 7.

FIG. 8 shows an enlarged plan of the fabric in which the top shute knuckles or the CD knuckles are higher than other CD knuckles are shaded, for example as a result of the pencil tracing illustrated in FIG. 7. It is these higher CD knuckles that cause the opposing diagonal twill patterns in this example of an interrupted $1\times2$ weave pattern. These diagonally extending line patterns of CD knuckles tends to a perception of an embossed effect on the sheet by the forming fabric which effect enhances the cloth-like appearance of the tissue sheet material produced by this fabric.

While a particular embodiment of the present invention has been herein illustrated and described, it is not intended to limit the invention to the particular disclosures embodied herein. The skilled fabric designer may modify the weave pattern to provide various techniques for producing a desired arrangement of drainage channels in the upper ply of the fabric and suitable control of the drainage by controlling the porosity in the lower ply of the fabric underlying the channel. Such design parameters are within the scope of the invention as defined by the appended claims.

We claim:

1. A forming fabric for use at the wet end of a paper making machine to receive wet pulp and form the same into a consolidated web by affording discharge of the free water content of the wet pulp, comprising a multi-ply fabric having a width in the cross direction (CD) corresponding to the width of the paper making machine and a length in the machine direction (MD) in the form of a continuous loop corresponding to the length of the path of travel of the fabric through the paper machine, the uppermost ply of said multi-ply fabric comprising a self-sustaining weave construction having monofilament warp filaments of a given diameter interwoven with shute filaments in a selected weave pattern, the lowermost ply of said multi-ply fabric comprising a series of warp filaments and shute filaments interwoven with said warp filaments to produce a self-sustaining fabric construction which is characterized by a high degree of porosity, and integrated binder filaments interconnecting the upper and lower plies, and being interwoven with the upper and lower plies, said upper ply providing on the paper side of the wire an array of elongated CD knuckles spanning multiple MD filaments in a diagonal line pattern, all of said MD filaments in said self-sustaining weave of the upper ply when viewed from the top providing a drainage channel between each two adjacent MD filaments, said MD filaments being disposed in groups providing wide drainage channels between groups and at least one narrow channel between the filaments in each group, said MD filaments in the lower ply interwoven with CD filaments to provide on the machine side an array of CD knuckles transverse to the channels provided between the group of MD filaments in the upper ply.

2. A fabric according to claim 1 wherein said elongated CD knuckles in the diagonal lines on the paper side predominate over the MD knuckles in said upper ply and the CD knuckles of said integrated binder filaments, said diagonal lines being topographic and the drainage channels being hidden within the fabric.

3. A fabric according to claim 2 wherein said predominant CD knuckles produce second diagonal lines on the paper side crosswise to said first diagonal lines, said second diagonal lines also being topographic on the paper side of the fabric.

4. A fabric according to claim 1 wherein each of the upper and lower plies has a single-layer weave construction.

5. A fabric according to claim 4 wherein said binder filament passes over at least one group of MD filaments in the upper ply and under at least one MD filament in the lower ply.

6. A fabric according to claim 5 wherein said binder filament passes under two MD filaments and over four MD filaments in the lower ply in each repeat of the weave pattern in the lower ply.

7. A fabric according to claim 5 wherein said binder filament passes under four MD filaments and over two MD filaments in the lower ply in each repeat of the weave pattern in the lower ply.

8. A fabric according to claim 5 wherein said MD filaments in the lower ply are disposed to provide effective width of the filament which is greater than its height.

9. A fabric according to claim 8 wherein said MD filaments in the lower ply are disposed in groups in which the filaments are longitudinally abutting.

10. A fabric according to claim 9 wherein said MD filaments groups in the lower ply consist of pairs.

11. A fabric according to claim 1 wherein said integrated binder filaments cooperate with the MD filaments in the lower ply to produce MD open channels between selected MD filaments of the lower ply and position the MD open channels in vertical registry with the wide channels between the groups of MD filaments in the upper ply.

12. A fabric according to claim 1 wherein said integrated binder filaments cooperate with the MD filaments in the lower ply to produce MD open channels between selected MD filaments of the lower ply and position the MD open channels out of vertical registry with the wide channels between the groups of MD filaments in the upper ply.

13. A fabric for a paper making machine to convey a consolidated web, comprising a multi-ply fabric having a width in the cross direction (CD) corresponding to the width of the paper making machine and a length in the machine direction (MD) in the form of a continuous loop corresponding to the length of the path of travel of the fabric through the paper machine, the uppermost ply of said multi-ply fabric comprising a self-sustaining weave construction having monofilament warp filaments of a given diameter interwoven with shute filaments in a selected weave pattern, the lowermost ply of said multi-ply fabric comprising a series of warp filaments and shute filaments interwoven with said warp filaments to produce a self-sustaining fabric construction, and integrated binder filaments interconnecting the upper and lower plies, and being interwoven with the upper and lower plies, said upper ply providing on the paper side of the wire a predominant array of elongated CD knuckles spanning multiple MD filaments in a diagonal line pattern in one direction, said knuckles producing a diagonal line pattern in the opposition direction, said MD filaments in the upper ply when viewed from the top providing drainage channels between each two adjacent MD filaments, said MD filaments being disposed in groups providing wide channels between groups and at least one narrow channel between the filaments in each group, said diagonal line patterns being topographic and said channels being within the fabric, said MD filaments in the lower ply interwoven with CD filaments to provide on the machine side an array of CD knuckles transverse to the channels provided between the group of MD filaments in the upper ply.

* * * * *